US011272291B2

(12) United States Patent
Hwang

(10) Patent No.: US 11,272,291 B2
(45) Date of Patent: Mar. 8, 2022

(54) MULTILAYER PANEL SPEAKER AND METHOD OF MANUFACTURING THE SAME

(71) Applicants: Hyundai Motor Company, Seoul (KR); Kia Motors Corporation, Seoul (KR)

(72) Inventor: Yonghwan Hwang, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 17/038,686

(22) Filed: Sep. 30, 2020

(65) Prior Publication Data

US 2021/0314709 A1 Oct. 7, 2021

(30) Foreign Application Priority Data

Apr. 7, 2020 (KR) ..... 10-2020-0042206

(51) Int. Cl.
*H04R 9/06* (2006.01)

(52) U.S. Cl.
CPC ..... *H04R 9/06* (2013.01); *H04R 2209/027* (2013.01)

(58) Field of Classification Search
CPC ..... H04R 9/06; H04R 2209/027
See application file for complete search history.

(56) References Cited

U.S. PATENT DOCUMENTS

2013/0051597 A1* 2/2013 Yeom ..... H04R 9/046 381/353
2014/0241564 A1* 8/2014 Kang ..... H04B 1/3888 381/386

FOREIGN PATENT DOCUMENTS

KR 101353442 B1 1/2014

* cited by examiner

*Primary Examiner* — Sunita Joshi
(74) *Attorney, Agent, or Firm* — Mintz Levin Cohn Ferris Glovsky and Popeo, P.C.; Peter F. Corless

(57) ABSTRACT

A multilayer panel speaker includes a yoke having a bottom portion and a side portion, a first vibration panel fixed to the bottom portion and supported by a frame, and a second vibration panel fixed to the side portion. By using a multilayer panel, it is possible to improve high frequency and low frequency sensitivity in the multilayer panel speaker.

7 Claims, 6 Drawing Sheets

MULTILAYER PANEL SPEAKER AND METHOD OF MANUFACTURING THE SAME

CROSS-REFERENCE TO RELATED APPLICATION(S)

This application claims under 35 U.S.C. § 119 the benefit of Korean Patent Application No. 10-2020-0042206, filed on Apr. 7, 2020 in the Korean Intellectual Property Office, the entire contents of which are incorporated by reference herein.

BACKGROUND

1. Technical Field

The disclosure relates to a multilayer panel speaker, more particularly, to multilayer panel speaker capable of improving high frequency and low frequency sensitivity by using a multilayer panel, and a method of manufacturing the same.

2. Description of the Related Art

In general, a panel speaker is configured by attaching a vibrator including a magnet (permanent magnet), a yoke, and a voice coil to a panel, and generates sound by converting electrical energy into mechanical energy by the voice coil.

That is, when a current signal including several frequencies is applied to the voice coil, the voice coil generates mechanical energy according to an intensity of current and a magnitude of frequency, and causes the panel attached to the voice coil to generate vibration, and ultimately generates a sound pressure of a predetermined size that the human ear may perceive the sound pressure.

However, because a conventional vibrator speaker generates sound pressure by using only a single panel, when a vibrator is attached to a panel, the resonant frequency becomes higher than the use band, so that low frequency sensitivity decreases.

In addition, when a vibrator is attached to a single panel, the minimum resonance frequency and low frequency sensitivity decrease, and when a magnet with a larger mass is attached to a panel in order to lower the minimum resonance frequency, low frequency sensitivity increases, but high frequency sensitivity decreases.

SUMMARY

It is an aspect of the disclosure to provide a multilayer panel speaker capable of improving high frequency and low frequency sensitivity by using a multilayer panel, and a method of manufacturing the same.

Additional aspects of the disclosure will be set forth in part in the description which follows and, in part, will be obvious from the description, or may be learned by practice of the disclosure.

In accordance with an aspect of the disclosure, a multilayer panel speaker includes a yoke having a bottom portion and a side portion, a first vibration panel fixed to the bottom portion and supported by a frame, and a second vibration panel fixed to the side portion.

The multilayer panel speaker may further include a magnet installed opposite the bottom portion to which the first vibration panel is fixed, and a voice coil installed on the second vibration panel.

A resonance frequency of the first vibration panel may be lower than a resonance frequency of the second vibration panel.

A thickness of the first vibration panel may be less than that of the second vibration panel.

A length of the first vibration panel may be greater than that of the second vibration panel.

In accordance with another aspect of the disclosure, a method of manufacturing a multilayer panel speaker includes a first vibration panel ng step of fixing a first vibration panel to a bottom portion of a yoke, a second vibration panel fixing step of fixing a second vibration panel to a side portion of the yoke, and a vibration panel installation step of installing the first vibration panel to a frame.

A magnet may be installed opposite the bottom portion to which the first vibration panel is fixed, and a voice coil may be installed on the second vibration panel.

A resonance frequency of the first vibration panel may be lower than a resonance frequency of the second vibration panel.

A thickness of the first vibration panel may be less than that of the second vibration panel, and a length of the first vibration panel may be greater than that of the second vibration panel.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
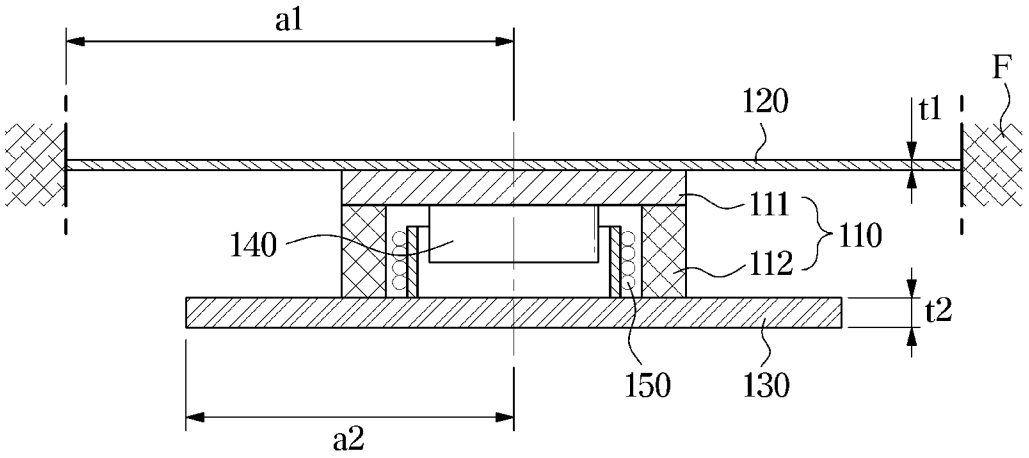
FIG. 1 illustrates a multilayer panel speaker according to an embodiment of the disclosure.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Hereinafter embodiments of the disclosure will be described in detail with reference to the accompanying drawings. The embodiments described below are provided by way of example so that those skilled in the art will be able to fully understand the spirit of the disclosure. The disclosure is not limited to the embodiments described below, but may be embodied in other forms. In order to clearly explain the disclosure, parts not related to the description are omitted from the drawings, and the width, length, thickness, etc. of the components may be exaggerated for convenience.

Hereinafter, a multilayer panel speaker according to an embodiment of the disclosure will be described with reference to FIGS. 1 to 3.

Figure 2:
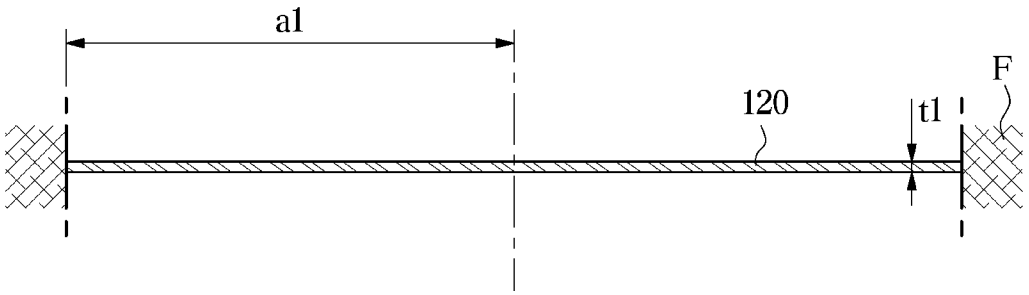
FIG. 2 illustrates a first vibration panel of the multilayer panel speaker according to an embodiment of the disclosure.
Figure 3:
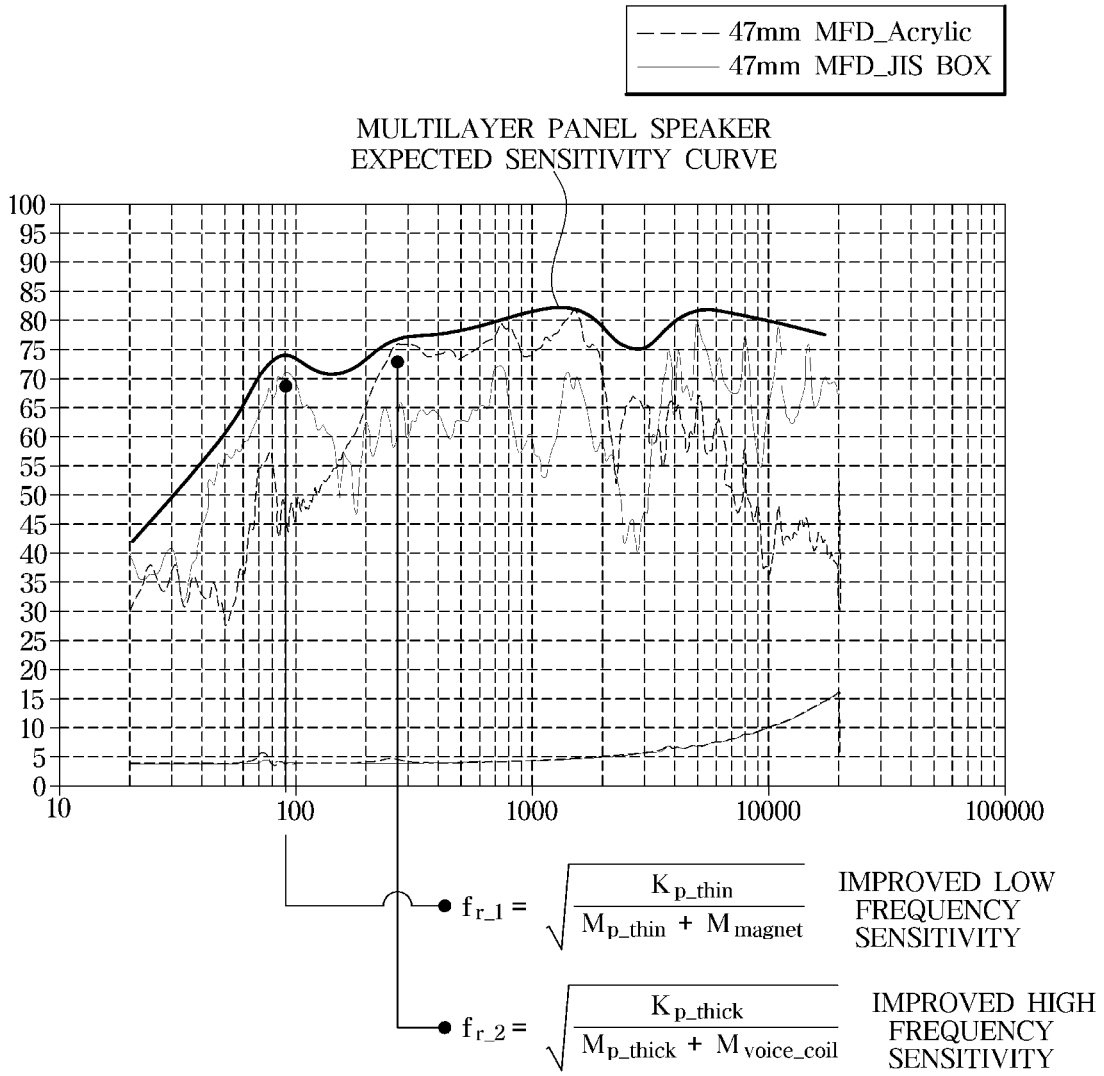
FIG. 3 illustrates frequency characteristics of the multilayer panel speaker according to an embodiment of the disclosure.

FIG. 1 illustrates a multilayer panel speaker according to an embodiment of the disclosure, FIG. 2 illustrates a first vibration panel of the multilayer panel speaker according to an embodiment of the disclosure, and FIG. 3 illustrates frequency characteristics of the multilayer panel speaker according to an embodiment of the disclosure.

As illustrated in FIGS. 1 to 3, a multilayer panel speaker according to an embodiment of the disclosure includes a yoke 110, a first vibration panel 120, a second vibration panel 130, a magnet 140, and a voice coil 150.

The yoke 110 includes a bottom portion 111 and a side portion 112, and is formed in a cylindrical shape with one of bottom surfaces open. The yoke 110 serves to form a magnetic circuit and provides an accommodation space for accommodating the magnet 140.

The first vibration panel 120 is fixed to the bottom portion 111 and supported by a frame F. The first vibration panel 120 may be firmly fixed to the bottom portion 111 by using a fixing means, and for example, may be firmly fixed to the bottom portion 111 using a bolt and a nut or an adhesive.

The first vibration panel 120 may be formed in a disk shape having a predetermined thickness t1 and length 2*a*1. An outer circumferential surface of the first vibration panel 120 may be constrained by the frame F and may be supported on the frame F in a state of being firmly fixed to the frame F.

The second vibration panel 130 is fixed to the side portion 112, and the voice coil 150 is installed on the second vibration panel 130. The second vibration panel 130 is installed to face the first vibration panel 120 and may be formed in a disk shape having a predetermined thickness #2 and length 2*a*2.

The thickness t1 of the first vibration panel 120 may be less than the thickness #2 of the second vibration panel 130, and the length 2*a*1 of the first vibration panel 120 may be greater than the length 2*a*2 of the second vibration panel 130.

That is, the first vibration panel 120 may be formed in a shape in which the length 2*a*1 is long and the thickness t1 is relatively low (i.e., thin) to form a low resonance frequency, and the second vibration panel 130 may be formed in a shape in which the length 2*a*2 is short and the thickness t2 is relatively high (i.e., thick) to form a high resonance frequency, so that the first vibration panel 120 may improve low frequency sensitivity and the second vibration panel 130 may improve high frequency sensitivity.

The first vibration panel 120 and the second vibration panel 130 may be made of different materials.

The magnet 140 is made of a permanent magnet and is installed on a surface opposite to the surface of the bottom portion 111 to which the first vibration panel 120 is fixed among opposite surfaces of the bottom portion 111 of the yoke 110.

The voice coil 150 is installed on the second vibration panel 130 and formed in a hollow cylindrical shape to be spaced apart from an outer circumferential surface of the magnet 140 and surround the magnet 140. An upper end of the voice coil 150 is spaced apart from the bottom portion 111 by a predetermined distance so as not to be in contact with the bottom portion 111 of the yoke 110 on which the magnet 140 is installed, and the voice coil 150 generates sound by vibrating the first vibration panel 120 and the second vibration panel 130 by a magnetic circuit and mutual electromagnetic force when an electric signal is applied. Hereinafter, the resonance frequencies of the first and second vibration panels 120 and 130 will be described in detail.

The resonance frequencies of the first and second vibration panels 120 and 130 may be expressed through equivalent mass and equivalent stiffness in a case where radiuses a1 and a2 of the first and second vibration panels 120 and 130 are 10 times or more of the thicknesses t1 and t2, that is, a ratio of the thicknesses t1 and t2 to the radiuses a1 and a2 is 1:10 or more, and the first and second vibration panels 120 and 130 are fixed in a circular state.

Equation 1 is an equation expressing the equivalent mass of the first and second vibration panels 120 and 130, and Equation 2 is an equation for expressing the equivalent stiffness of the first and second vibration panels 120 and 130, Equation 3 is an equation for expressing the resonant frequencies of the first and second vibration panels 120 and 130 using Equations 1 and 2.

$$M_{eq} = \frac{192}{\Lambda^2} \cdot \rho \cdot (\pi a^2 t) \quad \text{[Equation 1]}$$

$$K_{eq} = 16\pi \frac{Et^3}{(1-\nu^2)a^2} \quad \text{[Equation 2]}$$

$$f_r \sqrt{\frac{K_{eq}}{M_{eq}}} = \frac{\Lambda}{2\pi} \frac{t}{a^2} \sqrt{\frac{E}{12\rho(1-\nu^2)}} \quad \text{[Equation 3]}$$

fr: Resonance frequency
Keq: Equivalent stiffness
Meq: Equivalent mass
Λ: Modal constant
t: Thickness of vibration panel
a: Radius of vibration panel
E: Elastic modulus
ρ: Density of vibration panel
v: Poisson's ratio As shown in Equation 3, it may be seen that the resonance frequency of the first vibration panel 120 decreases as a ratio of the thickness 11 and the square of the radius a1 of the first vibration panel 120 decreases, and it may be seen that a low resonance frequency is formed in a case where the length 2*a*1 of the first vibration panel 120 is long and the thickness t1 is thin and a high resonance frequency is formed in a case where the length 2*a*2 of the second vibration panel 120 is short and the thickness t2 is thick.

Because the first vibration panel 120 is coupled to the magnet 140 through the yoke 110, in order to grasp the overall resonance frequency of the first vibration panel 120, the masses of the yoke 110 and the magnet 140 need to be considered, and this may be expressed as Equation 4.

$$f_{r_1} = \sqrt{\frac{K_{p_thin}}{M_{p_thin} + M_{magnet}}} \quad \text{[Equation 4]}$$

fr_1: Resonance frequency of first vibration panel
Kp_thin: Equivalent stiffness of first vibration panel (thin plate)
Mp_thin: Equivalent mass of first vibration panel (thin plate)
Mmagnet: Mass of yoke and magnet Because the voice coil 150 is coupled to the second vibration panel 130 in order to grasp the overall resonance frequency of the second vibration panel 130, the mass of the voice coil 150 need to be considered, and this may be expressed as Equation 5.

$$f_{r_2} = \sqrt{\frac{K_{p_thick}}{M_{p_thick} + M_{voice_coil}}} \quad \text{[Equation 5]}$$

fr_2: Resonance frequency of second vibration panel
Kp_thick: Equivalent stiffness of second vibration panel (thick plate)
Mp_thick: Equivalent mass of second vibration panel (thick plate)
Mvoice_coil: Mass of voice coil Through Equations 4 and 5, it may be seen that the greater the overall weight, the lower the resonance frequency is formed, and it may be seen that even though the shapes of the first and second vibration panels 120 and 130 are excluded, the overall resonance frequency of the first vibration panel 120 are formed lower than the overall resonance frequency of the second vibration panel 130.

That is, the multilayer panel speaker according to an embodiment of the disclosure may improve both low frequency sensitivity and high frequency sensitivity by controlling the lengths and thicknesses of the first and second vibration panels 120 and 130 and controlling the overall weight of the first and second vibration panels 120 and 130, thereby improving overall performance of the speaker.

FIG. 3 is a graph showing frequency characteristics of the first vibration panel 120 and the second vibration panel 130. As shown in FIG. 3, it may be seen that the low frequency sensitivity of the first vibration panel 120 to which the weights of the yoke 110 and the magnet 140 are added is improved, and it may be seen that the high frequency sensitivity of the second vibration panel 130 to which the weight of the voice coil 150, which is relatively lighter than the magnet 140, is added is improved. In FIG. 3, a horizontal axis represents frequency (unit: Hz), and a vertical axis represents sound pressure (unit: dB).

Figure 4:
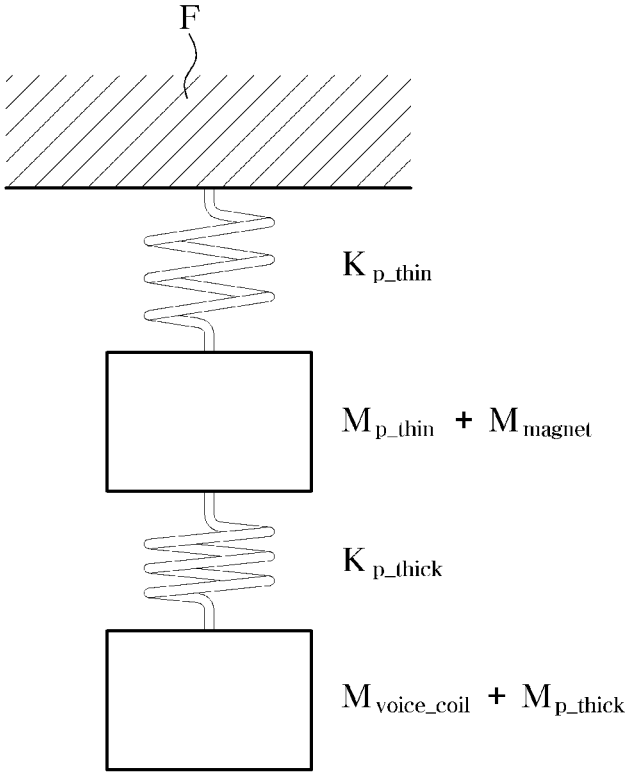
FIG. 4 illustrates the multilayer panel speaker according to an embodiment of the disclosure modeled as two degrees of freedom.
Figure 5:
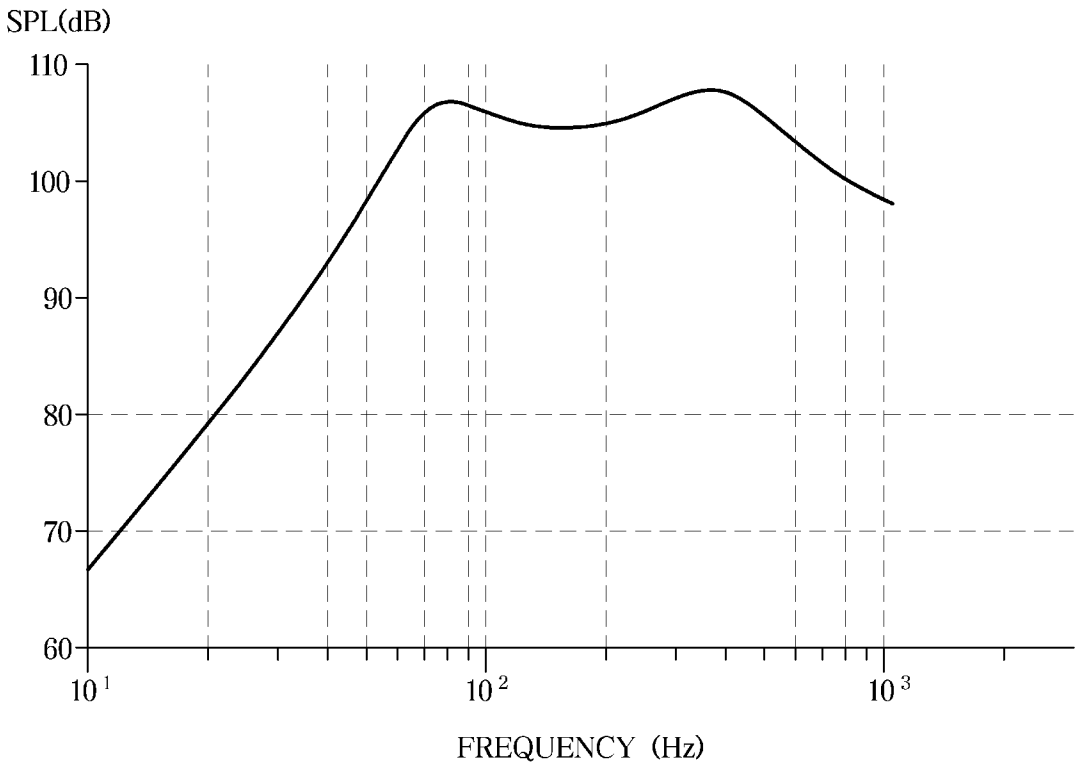
FIG. 5 illustrates frequency characteristics of the multilayer panel speaker according to FIG. 4.

FIGS. 4 and 5 illustrate to verify the interpretability of the disclosure.

Referring to FIG. 4, in general, because the first vibration panel 130 is integral with the speaker frame F, it may be assumed that the first vibration panel 130 is fixed to the frame F. Therefore, the multilayer panel speaker according to an embodiment of the disclosure may be modeled as two degrees of freedom (2 DOF).

The 2 DOF model may be verified by assuming that the physical properties of a plate are plastic and then by assuming the diameter of a thin plate, which is the first vibration panel 120, is 0.2 m, the thickness thereof is 0.002 mm, the diameter of a thick plate, which is the second vibration panel 130, is 0.1 m, the thickness thereof is 0.003 mm, and the mass of the magnet is 100 g, and by assuming that the Young's modulus, which is a physical property of the flat plate, is 1 GPa, the density thereof is 1100 kg/m^3, and the Poisson's ratio is 0.4.

In FIG. 4, Kp_thin, Mp_thin, Mmagnet, Kp_thick, Mp_thick, and Mvoice_coil have the same meaning as Kp_thin, Mp_thin, Mmagnet, Kp_thick, Mp_thick, Mvoice_coil of Equations 4 and 5 described above.

Referring to FIG. 5, it may be seen that a broadband low frequency characteristic in a range of about 80 to 400 Hz may be secured, and this may be adjusted according to the mass of a magnet, the size and properties of a flat plate. In particular, the resonant frequency position and sensitivity may be adjusted according to the constraints of the flat plate.

Figure 6:
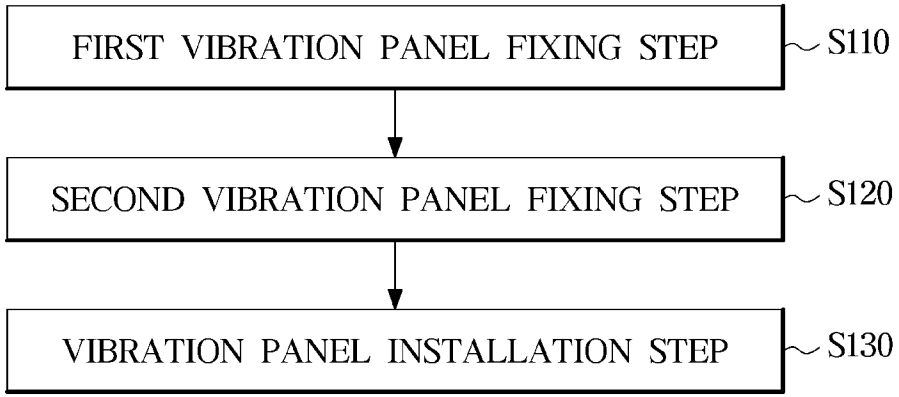
FIG. 6 illustrates a method of manufacturing the multilayer panel speaker according to an embodiment of the disclosure.

Hereinafter, a method of manufacturing the multilayer panel speaker according to an embodiment of the disclosure will be described with reference to FIG. 6.

A method of manufacturing the multilayer panel speaker according to an embodiment of the disclosure includes a first vibration panel fixing step (S110) of fixing the first vibration panel 120 to the bottom portion 111 of the yoke 110, a second vibration panel fixing step (S120) of fixing the second vibration panel 130 to the side portion 112 of the yoke 110, and a vibration panel installation step (S130) of installing the first vibration panel 120 to the frame F.

The magnet 140 may be installed opposite the bottom portion 111 to which the first vibration panel 120 is fixed, and the voice coil 150 may be installed on the second vibration panel 130. The magnet 140 and the voice coil 150 may be installed on the bottom portion 111 and the second vibration panel 130, respectively, before the vibration panel installation step S130.

The resonance frequency of the first vibration panel 120 may be lower than the resonance frequency of the second vibration panel 130. The thickness t1 of the first vibration panel 120 may be less than the thickness 12 of the second vibration panel 130, and the length 2*a*1 of the first vibration panel 120 may be greater than the length 2*a*2 of the second vibration panel 130.

As is apparent from the above, a multilayer panel speaker according to an embodiment of the disclosure includes a first vibration panel and a second vibration panel, and the mass of a magnet is added to the first vibration panel, so that the resonant frequency of the first vibration panel can be reduced, and thus, low frequency sensitivity of the first vibration panel can be improved.

Further, a voice coil, which is lighter in weight than the magnet, is installed on the second vibration panel, so that the resonant frequency of the second vibration panel can be higher than the resonant frequency of the first vibration panel, and thus, high frequency sensitivity of the second vibration panel be improved.

Although the present disclosure has been described above with reference to exemplary embodiments of the present disclosure, those skilled in the art will understand that the present disclosure may be variously modified and changed without departing from the spirit and scope of the present disclosure set forth in the appended claims.

What is claimed is:

1. A multilayer panel speaker, comprising:

a yoke having a bottom portion and a side portion;

a first vibration panel fixed to the bottom portion and supported by a frame; and a second vibration panel fixed to the side portion, wherein a resonance frequency of the first vibration panel is lower than a resonance frequency of the second vibration panel.

2. The multilayer panel speaker according to claim 1, further comprising:

a magnet installed opposite the bottom portion to which the first vibration panel is fixed; and a voice coil installed on the second vibration panel.

3. A multilayer panel speaker, comprising:

a yoke having a bottom portion and a side portion;

a first vibration panel fixed to the bottom portion and supported by a frame; and a second vibration panel fixed to the side portion, wherein a thickness of the first vibration panel is less than that of the second vibration panel.

4. The multilayer panel speaker according to claim 1, A multiplayer panel speaker, comprising:

a yoke having a bottom portion and a side portion;

a first vibration panel fixed to the bottom portion and supported by a frame; and a second vibration panel fixed to the side portion, wherein a length of the first vibration panel is greater than that of the second vibration panel.

5. A method of manufacturing a multi layer panel speaker, the method comprising:

a first vibration panel fixing step of fixing a first vibration panel to a bottom portion of a yoke;

a second vibration panel fixing step of fixing a second vibration panel to a side portion of the yoke; and a vibration panel installation step of installing the first vibration panel to a frame, wherein a resonance frequency of the first vibration panel is lower than a resonance frequency of the second vibration panel.

6. The method according to claim 5, wherein a magnet is installed opposite the bottom portion to which the first vibration panel is fixed, and a voice coil is installed on the second vibration panel.

7. A method of manufacturing a multilayer panel speaker, the method comprising:

a first vibration panel fixing step of fixing a first vibration panel to a bottom portion of a yoke;

a second vibration panel fixing step of fixing a second vibration panel to a side portion of the yoke; and a vibration panel installation step of installing the first vibration panel to a frame, wherein a thickness of the first vibration panel is less than that of the second vibration panel, and a length of the first vibration panel is greater than that of the second vibration panel.

* * * * *